United States Patent [19]

Ostrowski

[11] 4,223,716

[45] Sep. 23, 1980

[54] METHOD OF MAKING AND USING A CERAMIC SHELL MOLD

[75] Inventor: Richard C. Ostrowski, Dunlap, Ill.

[73] Assignee: Caterpillar Tractor Co., Peoria, Ill.

[21] Appl. No.: 971,981

[22] Filed: Dec. 4, 1978

[51] Int. Cl.[3] ..... B22C 1/04

[52] U.S. Cl. ..... 164/26; 164/41; 164/138; 164/361

[58] Field of Search ..... 164/26, 25, 24, 23, 164/138, 41, 361; 106/38.3, 38.35, 38.28

[56] References Cited

U.S. PATENT DOCUMENTS

| | | | |
|---|---|---|---|
| 3,126,597 | 3/1964 | Operhall et al. | 164/26 |
| 3,153,826 | 10/1964 | Horton | 164/26 |
| 3,184,813 | 5/1965 | O'Shea | 164/26 |
| 3,256,574 | 6/1966 | Lirones | 164/26 |
| 3,296,666 | 10/1967 | Lirones | 164/26 |
| 3,656,983 | 4/1972 | Sulinski | 106/38.3 |

FOREIGN PATENT DOCUMENTS

| | | | |
|---|---|---|---|
| 231069 | 3/1969 | U.S.S.R. | 164/23 |

*Primary Examiner*—Robert Louis Spruill
*Assistant Examiner*—Gus T. Hampilos
*Attorney, Agent, or Firm*—Charles E. Lanchantin, Jr.

[57] ABSTRACT

A method of making a shell mold (6) includes alternately applying a ceramic coating composition (8) and a stucco composition (10) to an expendable pattern, the presence of graphite being substantially avoided therein, and applying a barrier coating (16) thereto including a ceramic powder, a binder, and a preselected amount of graphite. A preferred range of graphite of about 13 to 17 Wt. % in the barrier coating (16) minimizes decarburization of a ferrous article formed in the cavity of the shell mold (6).

13 Claims, 1 Drawing Figure

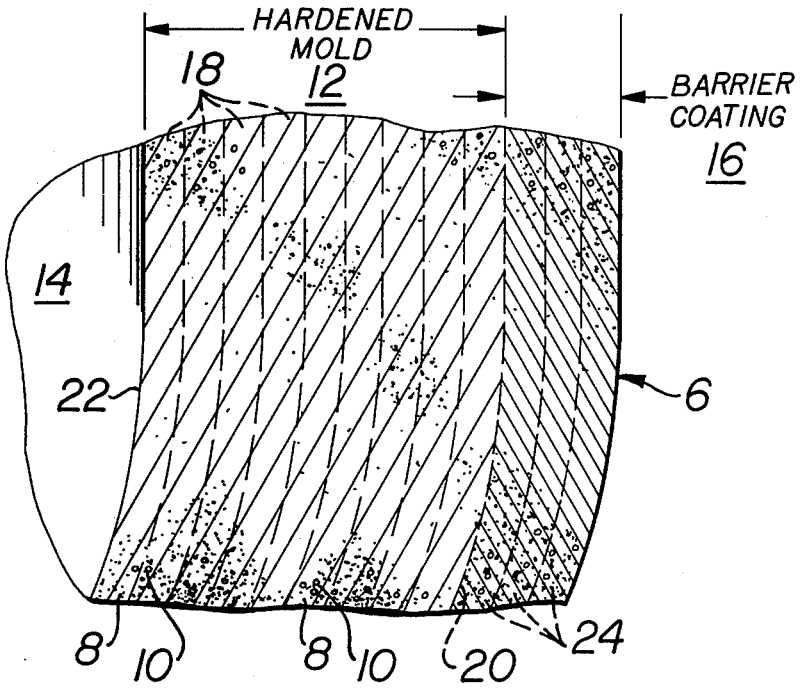
HARDENED
MOLD
12
18
BARRIER
COATING
16
14
22
6
8
10
8
10
20
24

METHOD OF MAKING AND USING A CERAMIC SHELL MOLD

DESCRIPTION

Technical Field

This invention relates to the preparation of a ceramic shell mold useful for investment casting purposes, and particularly to a method of making a shell mold that will effectively reduce the amount of surface decarburization of a ferrous article formed in the shell mold.

BACKGROUND ART

Investment casting, also referred to as the "lost wax" process, typically involves alternate applications of a ceramic coating composition and a stucco composition to an expendable pattern in order to provide a multi-layered shell mold. The pattern is usually mode of wax, plastic, or similar material which is melted out to leave a correspondingly shaped internal cavity into which molten metal is poured.

Unfortunately, there have been many attempts to control the surface finish and the amount of decarburization of steel investment castings. The problem of a metal-mold-atmosphere reaction at the time of pouring and initial stages of solidification of the molten metal has continued to cause an undesirable carbon-free zone adjacent the surface of the article as well as surface blemishes. The methods of minimizing this phenomenon have included casting in a vacuum, use of inert gas shrouding, the addition of reducing agents into the mold cavity prior to pouring, preheating the mold in a carbonaceous atmosphere prior to casting, etc. All of these production steps are costly, time-consuming or raise issues of safety to foundry personnel such as by producing noxious vapors.

U.S. Pat. No. 3,184,813 issued to P. J. O'Shea on May 25, 1965 and U.S. Pat. No. 3,296,666 issued to N. G. Lirones on Jan. 10, 1967 are representative of the large number of ceramic dip coat compositions used in building up multi-layered shell molds. Frequently, the compositions of the shell mold layers are tailored for the specific metal.

In the past, for example, graphite has been added to the usual coating composition of a ceramic powder and a binder in order to improve surface finish and to minimize the amount of decarburization of steel articles. But while the use of a relatively uniform amount of graphite throughout the full cross section of the shell mold wall has resulted in some improvement in the quality of the castings, surface irregularities and localized carburization have been observed because of the undesirable contact of the molten metal directly with the graphite particles. Moreover, the strength of the individually applied layers is reduced by graphite addition and the shell mold is more costly than desired.

The present invention is directed to overcoming one or more of the problems as set forth above.

DISCLOSURE OF INVENTION

In accordance with one aspect of the present invention, a ceramic shell mold is made by alternately applying coating compositions and stucco compositions to an expendable pattern forming a resultant multi-layered mold substantially free of graphite, and applying a barrier coating to the exterior surface of the multi-layered mold, with the barrier coating including a mixture of a ceramic powder, a binder, and a preselected amount of graphite. Preferably, the amount of graphite in the barrier coating is limited to a range of about 4 to 20 Wt.% of the solid portion.

In another aspect of the invention, the shell mold is preferably made by heating the multi-layered mold and forming a resultant hardened mold before the barrier coating is applied.

In another aspect of the invention, the abovedescribed multi-layered mold and barrier coating are heated and a ferrous molten metal poured into the cavity, whereupon after cooling and removal of the article from the mold the article will be noted to have minimal surface carbon depletion and a relatively smooth surface.

BRIEF DESCRIPTON OF DRAWING

The sole FIGURE is a diagrammatic and enlarged, fragmentary cross sectional view through a multi-layered shell mold having a barrier coating thereon in accordance with the present invention.

BEST MODE FOR CARRYING OUT THE INVENTION

A preferred method of making a ceramic shell mold 6 comprises the steps of alternately applying a ceramic coating composition 8 and a stucco composition 10 to an expendable or thermally meltable pattern a preselected number of times, firing such mult-layered mold to remove the pattern and provide a hardened mold 12 having an internal casting cavity 14, and applying a barrier coating 16 including a ceramic power, a binder and a preselected amount of graphite as is generally illustrated in the drawing. The presence of any significant amount of graphite is preferably avoided in the multi-layered mold, particularly adjacent the casting cavity 14, and is preferably controlled to a range of about 13 to 17 Wt.% graphite of the total amount of the solid portion of the barrier coating 16.

The aforementioned ceramic coating composition 8 basically includes a ceramic powder and a binder. Typically, the ceramic powder is selected from the group consisting essentially of fused silica, vitreous silica, crystalline silica, alumina silicate, alumina, magnesium silicate, zircon, zirconium silicate, and clay treated to remove impurities, and can be mixtures thereof. The binder is selected from the group consisting essentially of colloidal silica sol, ethyl silicate, aluminum phosphate, and aqueous alkali metal silicate.

The stucco composition 10 basically includes conventional granular refractory materials such as zircon.

The multi-layered mold made by alternately applying the ceramic coating composition 8 and the stucco composition 10 a preselected number of times to the pattern is desirably substantially free of graphite. By this term it is meant that less than 0.5 Wt.% graphite is present in the multi-layered mold before the barrier coating 16 is applied.

More particularly, a preferred method of making the ceramic shell mold 6 includes the following steps:

Step (a) Forming an expendable or meltable pattern of wax, plastic or similar material of a construction having the desired shape;

Step (b) Applying a prime or first ceramic coating composition 8 including fused silica flour, finely divided zircon, a limited amount of nitrile polymer latex for low temperature strength, for example 2 Wt.%, and colloidal silica sol including water in the form of a slurry to the pattern by dipping the pattern into an agitated thixotropic slurry thereof, removing the coated pattern therefrom and allowing a preselected amount of draining and initial stages of setting thereof;

Step (c) Applying a coarser or stucco coating composition 10 including granular refractory material such as zircon to the still wet first coating composition 8 by sprinkling same thereon from a conventional rainfall sander, or alternately by immersing it in a conventional fluidized bed, and with the AFS grain size of the stucco coating composition being generally limited to a range of from about 35 mesh to 20 mesh (about 0.5 mm to 0.8 mm);

Step (d) Drying the coated and stuccoed pattern for a preselected time period, for example 30 minutes to 6 hours, to a waterproof or gelled shape and providing a first layer 18;

Step (e) Alternately repeating Steps (b), (c), and (d) a preselected number of times while preferably increasing the relative coarseness of the solid particles therein, for example for nine cycles, and providing a multi-layered "green" mold having a plurality of the layers 18, each layer being about 1 mm (0.040") thick and intimately associated with each other as is representatively indicated in the drawing;

Step (f) Heating the multi-layered "green" mold in an autoclave at a preselected first temperature of about 180° to 200° C. (350° to 400° F.) for about 5 to 25 minutes, melting out and removing the pattern, and providing some strength to the mold;

Step (g) Firing the multi-layered mold in a furnace at a preselected second temperature of about 800° to 1400° C. (1500° to 2500° F.), and preferably about 1000° C. (1800° F.) for about one hour to provide a hardened mold 12 having an exterior surface 20, and an interior surface 22 facing the casting cavity 14 as shown in the drawing;

Step (h) Applying a barrier coating layer 24 to the exterior surface 20 of the hardened mold 12 while it is at a preselected third temperature of about 200° C. (400° F.), the barrier coating layer including a mixture of zircon, fused silica, finely divided graphite, and colloidal silica sol, the AFS grain size of the graphite prticles being preferably limited in size to passing through a 200 mesh sieve (less than about 0.075 mm or 0.003"), and being most desirably limited to a range of about 600 mesh to 325 mesh (about 0.01 mm to 0.05 mm), and limiting the amount of graphite to a range of about 4 to 20 Wt.% of the solid or dry portion of the mixture;

Step (i) Drying the barrier coating layer for a preselected period of time;

Step (j) Repeating Steps (h) and (i) a plurality of times, for example three times, to provide a plurality of the graphite containing barrier coating layers 24 to define the multi-layered barrier coating 16 as shown in the drawing; and Step (k) Heating the hardened mold 12 and the barrier coating 16 in a furnace of the like to a preselected third temperature of about 900° to 1400° C. (1650° to 2550° F.), and preferably about 1050° C. (1920° F.) to make the ceramic shell mold 6.

Subsequently, a ferrous molten metal such as steel is poured into the casting cavity 14 of the ceramic shell mold 6. Most desirably, the mold is maintained at a temperature of about 1000° C. (1830° F.), or slightly below, since the molten metal poured therein is about 1350° to 1700° C. (2460° to 3100° F.) and this minimizes the temperature differential therebetween.

Various modifications of Steps (a) through (k) set forth above can be visualized without departing from the spirit of the present invention. For example, drying Step (d) can be achieved under ambient air conditions for a period of about one-half to one hour, or alternatively the drying can be achieved in an oven or furnace at a temperature slightly above ambient temperature to reduce the holding time. Of course, the temperature cannot be elevated too much because the pattern either can melt or can expand to the point of unduly stressing the relatively weak walls of the partially complete mold.

One of the advantages of this method of investment casting is that it is easier to melt out and remove the pattern from the multi-layered mold because it has a thinner section during intermediate Step (f) than the equivalent strength prior art shell mold has at the time of pattern removal. I have also noted a consistently higher quality of the hardened molds 12 when compared with the thicker prior art molds. Furthermore, Step (g) can be achieved without the need for a reducing atmosphere because the multi-layered mold is substantially free of graphite at that stage.

Moreover, in Step (h) zircon can be replaced by an equivalent amount of alumina silicate. The barrier coating is preferably about 78 Wt% of dry materials including the aforementioned zircon or alumina silicate, fused silica, and graphite, and the remaining 22 Wt.% is substantially liquid binder including the colloidal silica sol. Specifically, the preferred proportions of the dry materials in the barrier coating 16 are about 75 parts zircon, 25 parts fused silica, and 11 to 25 parts graphite by weight.

In actuality, Steps (h), (i), and (j) were achieved by repetitively dipping the hardened mold 12 while hot into an agitated thixotropic solution of the aforementioned ceramic and graphite materials for about four or five seconds and removing the mold to permit substantial gelling of the ceramic materials during periods of about 30 seconds therebetween in ambient air. The fact that the mold is hot accelerates the gelling and tends to bridge the ceramic materials over any minor imperfections. Such dipping was automatically accomplished by a known mechanical dipping apparatus provided with a suitable timing and counting control system, not shown.

Industrial Applicability

In order to determine the optimum range of graphite in the barrier coating 16, various weight percentages of graphite were added to the zircon and fused silica portions thereof. Steel articles were made by pouring steel of about 0.3 Wt.% carbon into the heated ceramic shell molds 10 as mentioned above, and the carbon free depth (CFD) and maximum affected depth (MAD) from the surface of the article measured after sectioning of the article. The carbon free depth (CFD) is a measure of the thickness of the surface zone that has experienced substantially total decarburization. The maximum affected depth (MAD) is a measure of the thickness of a thicker surface zone that has experienced at least partial decarburization or a substantive deviation from the carbon level of the central body portion of the article. The test results were as follows:

| | Prior Art | 4.8 Wt. % | 9.1 Wt. % | 13.1 & 16.7 Wt. % |
|---|---|---|---|---|
| CFD | 0.3mm | 0.13mm | 0.10mm | 0.05mm |

-continued

| | Prior Art | 4.8 Wt. % | 9.1 Wt. % | 13.1 & 16.7 Wt. % |
|---|---|---|---|---|
| | (0.012") | (0.005") | (0.004") | (0.002") |
| MAD | 0.9mm | 0.64mm | 0.51mm | 0.3mm |
| | (0.035") | (0.025") | (0.020") | (0.012") |

Thus, the test data indicates that the prior art ceramic shell mold with substantially no graphite therein exhibited an undesirably high level of decarburization, and the articles prepared in accordance with one aspect of the present invention exhibited a decreasing degree of decarburization as the proportion of graphite in the barrier coating 16 increased up to about 17 Wt.%.

In addition to such decarburization measurements, which typically reflect the amount of surface material that must be removed so that any subsequent heat treatment effect of the carbon will be uniform throughout the steel article, the surface smoothness of the test articles was noted. For example, the relatively frequent valleys of about 1.5 mm (0.060") maximum depth in the prior art articles were proportionately reduced to minimal blemishes of less than about 0.4 mm (0.015") with the addition of graphite toward 15 Wt.% in the barrier coating 16. I found out also that at about 3.4 Wt% graphite the effect on decarburization was minimal, whereas at the other end of the range at about 20 Wt.% graphite, the graphite was difficult to keep in suspension, tended to agglomerate and thereby weaken the layers, and did not appear to result in any significant change in the results from that of about 15 Wt.% graphite proportion.

In view of such beneficial results, the broad range of graphite in the barrier coating 16 is about 4 to 20 Wt.%, the preferred range is about 13 to 17 Wt.%, and the most desirable amount is about 15 Wt.%.

It is of note to appreciate that the problems of decarburization and surface blemishes of investment cast articles is more severe when the amount of carbon in the ferrous molten metal is reduced toward 0.1 Wt.% carbon. Thus, the method of the present invention is particularly useful for minimizing decarburization of steel articles with less than 1.5 Wt.% carbon.

Moreover, although the preferred method of making the shell mold 6 includes the step of heating the multi-layered mold prior to applying the barrier coating 16 thereto, I contemplate that the multi-layered mold substantially free of graphite and the barrier coating can be sequentially built-up and then the resultant structure heated to remove the wax pattern and to form hardened shell mold 6. In either method, graphite is reactive to oxygen, and the reaction is accelerated as the temperature increases. In a crystalline material such as the shell mold, graphite will travel in the porous interstices thereof during heating. I theorize that during pouring of molten metal into the shell mold a portion of the graphite in the barrier coating 16 diffuses inwardly toward the casting cavity 14 while at the same time a portion of the carbon in the molten metal tends to diffuse into the shell mold where oxygen is available. Under any theory, however, carbon depletion is greatly minimized by the method of present invention.

Other objects, aspects and advantages of this invention can be obtained from a study of the drawings, the disclosure and the appended claims.

I claim:

1. A method of making a ceramic shell mold (6) comprising:

Step (a) alternately applying a coating composition (8) including a ceramic powder and a binder, and then a stucco composition (10) including granular refractory material to an expendable pattern a preselected number of times, drying the coating between applications, and forming a resultant multi-layered mold, said multi-layered mold having less than 0.5 Wt.% graphite:

Step (b) heating the multi-layered mold, removing the pattern, and forming a resultant hardened mold (12); and Step (c) applying a barrier coating (16) to the exterior surface of the multi-layered mold (12) while the hardened mold (12) is at a preselected temperature above ambient, said barrier coating (16) including a mixture of a ceramic power, a binder, and a preselected amount of particulate graphite within a range of about 4 to 20 Wt.% of the solid portion of the barrier coating (16).

2. The method of claim 1 wherein Step (c) includes applying the barrier coating (16) to the hardened mold (12) while the hardened mold has a temperature of about 200° C.

3. The method of claim 1 wherein Step (c) includes selecting the barrier coating mixture as a thixotropic solution of zircon, fused silica, particulate graphite and colloidal silica sol.

4. The method of claim 1 wherein Step (c) includes selecting the barrier coating mixture as a thixotropic solution of alumina silicate, fused silica, particulate graphite and colloidal silica.

5. The method of claim 1 including maintaining said preselected amount of particulate graphite in a range of about 13 to 17 Wt.% of the solid portion of the barrier coating (16).

6. The method of claim 1 including selecting said preselected amount of particulate graphite at about 15 Wt.% of the solid portion of the barrier coating (16).

7. The method of claim 1 including maintaining said preselected amount of particulate graphite in a size range less than about 0.075 mm.

8. The method of claim 1 including maintaining said preselected amount of particulate graphite within an AFS grain size range of about 0.01 mm to 0.05 mm.

9. The method of claim 1 wherein Step (c) includes repetitively dipping the hardened mold (12) into and removing the hardened mold (12) from an agitated thixotropic solution of the barrier coating (16).

10. A method of investment casting of a ferrous article in a shell mold (6) comprising:

Step (a) applying a coating composition (8) including a ceramic powder and binder to an expendable pattern, said ceramic powder being selected from the group consisting essentially of fused silica, vitreous silica, crystalline silica, alumina silicate, alumina, magnesium silicate, zircon, zirconium silicate, and clay, and binder being selected from the group consisting essentially of colloidal silica sol, ethyl silicate, aluminum phosphate, and aqueous alkali metal silicate;

Step (b) applying a stucco composition (10) including a grangular refractory material:

Step (c) alternately repeating Steps (a) and (b) a preselected number of times and forming a multi-layered mold, said multi-layered mold having less than 0.5 Wt.% graphite;

Step (d) heating the multi-layered mold and forming a hardened mold (12) having an internal cavity (14);

Step (e) applying a barrier coating (16) to the exterior surface (20) of the hardened mold (12) at a location spaced from the internal cavity (14) and while the hardened mold (12) is at a preselected temperature above ambient, said barrier coating (16) having a solid portion and being a mixture of a ceramic powder, a binder, and a preselected amount of finely divided graphite, said preselected amount of graphite being within a range of about 4 to 20 Wt.% of the solid portion of the barrier coating (16);

Step (f) heating the hardened mold (12) and barrier coating (16) and forming a hot shell mold (6); and Step (g) pouring a ferrous molten metal into the internal cavity (14) of the hot shell mold (6).

11. The method of claim 10 wherein Step (e) includes maintaining said preselected amount of graphite in a range of about 13 to 17 Wt.%.

12. The method of claim 10 wherein Step (e) includes dipping the hot hardened mold (12) into a thixotropic solution a preselected number of times to apply the barrier coating (16).

13. The method of claim 12 wherein Step (e) includes maintaining the finely divided graphite in the thixotropic solution within an AFS grain size range of about 0.01 mm to 0.05 mm.

* * * * *